US006270554B1

(12) United States Patent
Queneau et al.

(10) Patent No.: US 6,270,554 B1
(45) Date of Patent: Aug. 7, 2001

(54) CONTINUOUS NICKEL MATTE CONVERTER FOR PRODUCTION OF LOW IRON CONTAINING NICKEL-RICH MATTE WITH IMPROVED COBALT RECOVERY

(75) Inventors: Paul E. Queneau, Cornish, NH (US); Carlos M. Diaz, Mississauga (CA)

(73) Assignee: Inco Limited, Toronto (CA)

( * ) Notice: Subject to any disclaimer, the term of this patent is extended or adjusted under 35 U.S.C. 154(b) by 0 days.

(21) Appl. No.: 09/525,092

(22) Filed: Mar. 14, 2000

(51) Int. Cl.[7] ..... C22B 15/00
(52) U.S. Cl. ..... 75/644; 75/677; 266/177
(58) Field of Search ..... 266/171, 177; 75/474, 433, 501, 644, 677

(56) References Cited

U.S. PATENT DOCUMENTS

| | | | | |
|---|---|---|---|---|
| 942,346 | | 12/1909 | Pierce et al. . | |
| 2,944,883 | | 7/1960 | Queneau et al. | 75/5 |
| 3,069,254 | | 12/1962 | Queneau et al. | 75/82 |
| 3,272,616 | * | 9/1966 | Queneau et al. | 75/644 |
| 3,723,096 | | 3/1973 | Parlee et al. | 75/21 |
| 3,832,163 | | 8/1974 | Themelis | 75/74 |
| 3,941,587 | | 3/1976 | Queneau et al. | 75/72 |
| 3,988,148 | * | 10/1976 | Queneau et al. | 75/677 |
| 4,085,923 | | 4/1978 | Queneau et al. | 266/215 |
| 4,252,560 | | 2/1981 | Vanjukov et al. | 75/21 |
| 4,266,971 | | 5/1981 | Schwartz et al. | 75/69 |
| 4,294,433 | | 10/1981 | Vanjukov et al. | 266/161 |
| 4,326,702 | | 4/1982 | Queneau et al. | 266/267 |
| 4,470,845 | | 9/1984 | Yannopoulos | 75/23 |
| 4,830,667 | | 5/1989 | Marcuson et al. | 75/76 |
| 5,180,423 | | 1/1993 | Marcuson et al. | 75/649 |
| 5,215,571 | | 6/1993 | Marcuson et al. | 75/626 |
| 5,449,395 | | 9/1995 | George | 75/645 |
| 5,853,657 | | 12/1998 | Diaz et al. | 266/145 |

FOREIGN PATENT DOCUMENTS

| | | |
|---|---|---|
| 2074678 | 2/1997 | (CA) . |
| 2851098 | 11/1978 | (DE) . |

OTHER PUBLICATIONS

P.E. Queneau, "The Coppermaking QS Continuous Oxygen Converter, Technology, Design and Offspring", *Extractive Metallurgy Of Copper, Nickel and Cobalt, The Paul E. Queneau, International Symposium: Volume 1, Fundamental Aspects*, Edited by R.G. Reddy,et al., pp. 447–471, TMS, Dec. 1993.

P.E. Queneau et al., "Oxygen Pyrometallurgy at Copper Cliff", pp. 14–21, *JOM*, vol. 48, No. 1, Jan. 1996.

P.E. Queneau et al., "Industrial–Scale Lead Making with the QSL Continous Oxygen Converter", pp. 38–44, *JOM*, vol. 48, No. 4, Apr. 1996.

C.J. Newman et al., "Recent Operation and Environmental Control in the Kennecott Smelter", pp. 29–45, *Copper 99–COBRE 99, volume 5, Smelting Operations and Advances*, edited by D.B. George, et al., TMS, Dec. 1999.

G.S. Victorovich et al., "Direct Production of Copper", vol. 39, No. 9, pp. 42–46, JOM, Sep., 1987.

G.S. Victorovich, "Oxygen Flash Converting for Production of Copper," pp. 501–529, *Extractive Metallurgy of Copper Nickel and Cobalt. The Paul E. Queneau International Symposium; volume 1 Fundamental Aspects*, edited by R.G. Reddy et al., TMS, Dec. 1993.

* cited by examiner

*Primary Examiner*—Scott Kastler
(74) *Attorney, Agent, or Firm*—Edward A. Steen

(57) ABSTRACT

A continuous nickel matte converter and method for the efficient production of low iron nickel-rich mattes from high-iron nickel-rich mattes, with minimal environmental impact. The present invention processes high-iron, nickel-rich primary furnace mattes to produce low iron, nickel-rich mattes, low value metal-containing slag and sulfur dioxide rich-off gas, with improved cobalt recovery. It eliminates use of the Peirce-Smith converter, with its undesirable environmental, metallurgical and economic features.

60 Claims, 1 Drawing Sheet

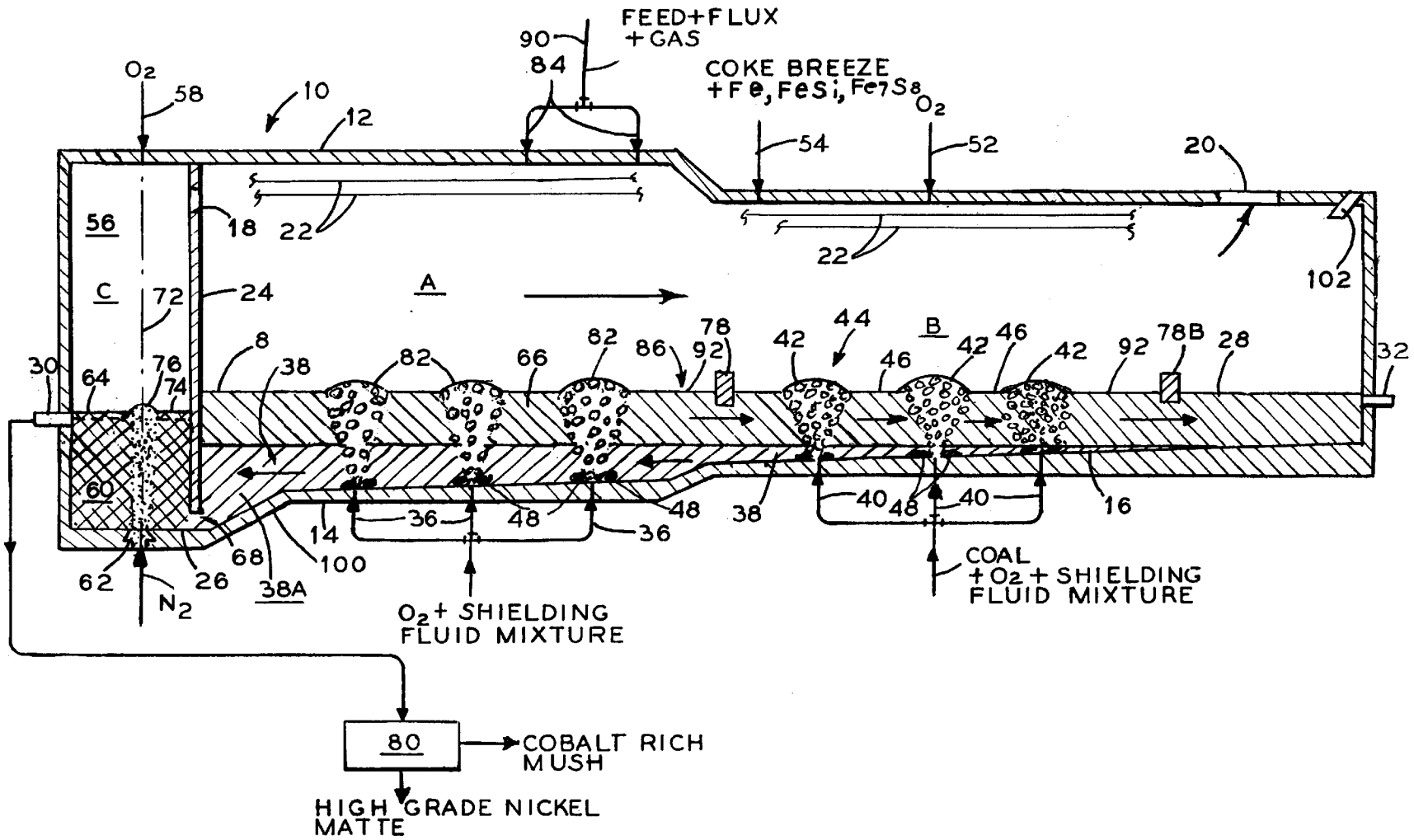
FEED+FLUX +GAS
COKE BREEZE +Fe, FeSi, Fe7S8
O2
COAL +O2+ SHIELDING FLUID MIXTURE
O2+ SHIELDING FLUID MIXTURE
COBALT RICH MUSH
HIGH GRADE NICKEL MATTE
N2
O2
A
B
C
10
12
14
16
18
20
22
24
26
28
30
32
36
38
38A
40
42
44
46
48
52
54
56
58
60
62
64
66
68
72
74
76
78
78B
80
82
84
86
90
92
100
102

CONTINUOUS NICKEL MATTE CONVERTER FOR PRODUCTION OF LOW IRON CONTAINING NICKEL-RICH MATTE WITH IMPROVED COBALT RECOVERY

TECHNICAL FIELD

This invention relates to a high intensity, energy efficient and environmentally protective oxygen reactor for single vessel pyrometallurgical economic treatment of high iron, nickel-cobalt mattes of controlled sulfur content, optionally containing copper, by continuous converting to produce nickel-cobalt or nickel-cobalt-copper mattes of low iron content with improved cobalt recovery, discard slag of low value-metal content, and gas of high sulfur dioxide content. The converter and methods replace technologically and economically inferior, low efficiency, batch operation Peirce-Smith converters. The latter environmentally and workplace hostile converters produce high value-metal containing slags and low $SO_2$-containing intermittent off-gas.

BACKGROUND OF THE INVENTION

There is a need in nonferrous pyrometallurgy to environmentally protectively convert high iron, nickel-cobalt and nickel-cobalt-copper mattes to low iron mattes in a single closed vessel, while discharging low value-metal containing slag and high sulfur dioxide containing off-gas. Since nickel ores all contain cobalt, increase in present practice low cobalt recovery is also important.

As an early and leading example of efforts in the above regard, the present co-inventor Queneau and Schuhmann "QS" continuous oxygen converter is a single vessel alternative to the standard chain of pyrometallurgical furnaces in series still used for the commercial production of copper, nickel and lead from their mineral concentrates and recycled materials. The QS converter is advocated as a replacement of current practice apparatus: sinter machines, blast furnaces, reverberatory, electric and flash smelting furnaces and Peirce-Smith converters, U.S. Pat. No. 942,346. Refer to P. E. Queneau and R. Schuhmann, U.S. Pat. Nos. 3,941,587; 4,085,923; and P. E. Queneau, "The Coppermaking QS Continuous Oxygen Converter, Technology, Design and Offspring", *Extractive Metallura of Copper, Nickel and Cobalt, the Paul E. Oueneau, International Symposium: Volume* 1, *Fundamental Aspects*, edited by R. G. Reddy, et al, pages 447–471, TMS, 1993. See also P. E. Queneau and S. W. Marcuson, "Oxygen Pyrometallurgy at Copper Cliff", pages 14–21, *JOM*, Volume 48, No. 1, January 1996, and P. E. Queneau and A. Siegmund, "Industrial-Scale Lead Making with the QSL Continuous Oxygen Converter", pages 38–44, *JOM* , Volume 48, No. 4, April 1996.

The QS converter is designed to accomplish continuous converting of copper, nickel, cobalt and lead mineral concentrates and recycled materials to metal or low iron matte, cleaning of the resulting slags and production of high strength sulfur dioxide off-gas, all in a single, countercurrent flow channel reactor, thus eliminating molten matte transfer. It's operations are carried out in a closed, fugitive emission-free, cylindrical, elongated, slightly sloped, tilting vessel. Overhead feeders and submerged Savard-Lee type gas injectors are employed to introduce metal sulfides, flux, oxygen and other gases, and carbonaceous material into the converter bath. The countercurrent matte-slag flow, concurrent gas—slag flow, smelting process utilizes the heat generated by the exothermic sulfur and iron oxidation reactions in the oxidizing zone, while generating a steady output of sulfur dioxide-rich gas. Low value-metal containing discharge slags are produced by submerged injection into the bath of oxygen and carbonaceous materials in the reducing zone for slag cleaning. The reactions generate a series of controlled oxygen potential regions in the bath, so that it progressively decreases in oxygen potential from product discharge to slag discharge. A key design concept of the QS converter is its length-long alternating, sequenced, chemically staged mixer-settler series of phase mixing by bottom blowing and phase separation by gravity settling. The principles of this converter are sound, but it is as yet only employed industrially for leadmaking.

Others have suggested a variety of methods conceived to solve the difficult problems associated with continuous pyrometallurgical conversion of metal sulfide concentrates to metal. In 1974 N. J. Themelis, U.S. Pat. No. 3,832,163, disclosed a coppermaking process and apparatus, known respectively as the Noranda process and Noranda reactor, characterized by continuous smelting and converting and concurrent flow of matte and slag, with most of the bath maintained in a high oxygen potential, turbulent state by oxygen-enriched air injection through the reactor's Peirce-Smith-type injectors. This bath smelting technology is employed industrially for the processing of high iron copper sulfide mineral flotation concentrates and copper-containing secondary materials to produce low iron-copper matte. The high value-metal containing slag produced requires separate treatment; air infiltration, and the gas injector design which limits the oxygen content of the bath oxidizing gas, decrease the sulfur dioxide concentration of the off-gas product. The new Kennecott Utah copper smelter employs a process which eliminates use of the Peirce-Smith converter. An Outokumpu flash smelting furnace produces low-iron copper matte from high iron copper sulfide mineral flotation concentrates. The molten matte is water-granulated, finely ground and dried, and continuously flash converted to blister copper in a Kennecott-Outokumpu flash converter. It's unconventional calcium ferrite slag is water-granulated and returned to the flash smelting furnace for value-metal recovery. The flash smelting furnace slag undergoes complex separate treatment for the recovery of its high value-metal content, and the concentrate produced is recycled back to the furnace. Both vessels employ oxygen-enriched air at 75–85% oxygen, and generate 35–40% $S0_2$ off-gas. The overall process achieves a sulfur capture in excess of 99.9%. Refer to C. J. Newman et al, "Recent Operation and Environmental Control in the Kennecott Smelter", pages 29–45, *COPPER 99-COBRE 99, Volume 5, Smelting Operations and Advances*, edited by D. B. George, et al, *TMS*, 1999. See also D. B. George, U.S. Pat. No. 5,449,395.

Inco successfully improved batch vessel pyrometallurgical coppermaking operations by utilizing efficient sequences of oxygen flash smelter, oxygen top blown, nitrogen bottom-stirred reactor vessels. Refer to S. W. Marcuson et al., U.S. Pat. No. 5,180,423, and C. M. Diaz et al., U.S. Pat. No. 5,853,657. They teach the use of a converting process wherein nitrogen is sparged into a molten bath of sulfur-saturated copper through porous refractory plugs located in the bottom of a converter. The nitrogen effects mixing in the bath and forms a bath "eye" on its surface. This eye provides an open window for intense oxygen penetration of the semi-blister copper, since floating mush is locally removed. A top-blowing lance, disposed above the eye, directs oxygen into the stirred copper, oxidizing it effectively.

Present co-inventor Diaz and others have also advocated improved copper production from flotation mineral concentrates by alternative routes. One of these suggestions comprises three separate operations: roasting of a fraction of the copper concentrate feed, autogenous oxygen flash smelting of the calcine blended with the remaining concentrate fraction, to crude copper and separate cleaning of the resulting slag. Refer to G. S. Victorovich, M. C. Bell, C. M. Diaz and J. A. E. Bell, "Direct Production of Copper," pages 42–46, *JOM*, September 1987, and G. S. Victorovich, "Oxygen Flash Converting for Production of Copper," pages 501–529, *Extractive Metallurgy of Copper Nickel and Cobalt. The Paul E. Oueneau International Symposium; Volume* 1 *Fundamental Aspects*, edited by R. G. Reddy et al., *TMS* 1993, See also S. W. Marcuson et al., U.S. Pat. No. 4,830,667. Another route advocated consists of autogenous oxygen flash smelting of common copper concentrate to an intermediate grade matte, followed by the continuous conversion of this material to semiblister, with full recycle of the converter slag to the flash furnace, C. M. Diaz et al., Canadian Patent 2,074,678. The principles of these improvements are sound, but the concepts have so far not been used industrially.

An important need, commonly neglected in nickel smelting of both sulfide and oxide ores, is major improvement in cobalt recovery. For example it may require separate processing of large amounts of converter or primary smelting slags. In Peirce-Smith converting, finishing to mattes containing a substantial amount of iron permits higher cobalt recovery in the matte. However, due to the constraints of current nickel refining practice, iron levels generally must be kept low, thereby denying producers an optimum iron level that increases cobalt recovery.

The ancient Peirce-Smith converter, still a workhorse in the nickel and copper industries, has serious deficiencies that call for its retirement. There is thus great interest in developing a single, economical, high capacity, energy efficient, low polluting vessel that continuously produces low iron, nickel-rich matte from high iron, nickel-rich matte, while simultaneously improving value-metal recovery including cobalt, and sulfur fixation.

The present invention is a useful, novel combination of elements of the QS continuous oxygen converter, the INCO oxygen top blowing-nitrogen bottom stirring reactor technology, and additional important techniques. Inherent process inefficiencies and environmental problems of Peirce-Smith converter practice are remedied by employment of the present Queneau-Diaz ("QD") continuous nickel matte converter as defined below:

- It is an economic, energy-efficient continuous oxygen reactor and process. The reactants are introduced to the closed reactor at well-defined steady state rates, while the finished product, slag and off-gas are continuously discharged, also at steady state rates. The continuous system permits and operates under comprehensive instrument process control of the reactor's physical (e.g., weights and temperatures) and chemical (e.g. staged bath oxygen potentials) conditions.
- When treating iron-rich, nickel-cobalt or nickel-cobalt-copper primary furnace mattes, the QD converter continuously yields low iron-containing matte, low value-metal containing, conventional iron silicate slag and high sulfur dioxide-containing gas, all superior to those produced in Peirce-Smith batch converter practice. The high iron content of the primary furnace matte is accompanied by furnace production of low value-metal containing discard slag.
- It eliminates fugitive emissions in the workplace and decreases the cost of off-gas sulfur fixation.
- It yields increased cobalt recovery of this valuable element.
- It optimizes the conditions for the establishment of highly effective, controlled chemical analysis bubble plumes in the reduction zone, by delivering pulverized bituminous coal to the submerged injectors by dense phase, uniform plug flow transport. The thus steady state higher oxygen concentration of the injected gas results in its lower momentum, improved heat and mass transfer in the bath, higher sulfur dioxide concentration in off-gas, and decreased operating difficulties in the atmosphere above the bath, thus increasing reactor capacity.
- It permits increased use of natural gas as a reductant for slag cleaning, by prior dispersion of a thermally minor quantity of highly reactive, combustible organic material in the gas.

SUMMARY OF THE INVENTION

This invention relates to a high intensity, energy efficient and environmentally protective continuous nickel converter that is technologically and economically superior for the pyrometallurgical treatment of high-iron mattes of controlled sulfur content containing nickel, cobalt, and copper and, more particularly, to an apparatus and a process for continuous treatment of high-iron nickel-rich mattes, optionally containing copper, by continuous oxygen converting to produce nickel and nickel-copper mattes of low iron content with improved cobalt recovery, discard slag of low value-metal content, and gas of high sulfur dioxide content The oxygen reactor and methods permit elimination of the technologically and economically inferior, low efficiency, batch operation Peirce-Smith converters currently employed in nickel and copper smelters. These environmentally and workplace hostile converters produce high value-metal containing slags and low $SO_2$ — containing intermittent off-gas streams, e.g., averaging respectively over 2% Ni and about 15% volume $S0_2$ at the converter mouth. Specifically, there are provided unique apparatus and methods for improved nickel-cobalt and nickel-cobalt-copper matte pyrometallurgy, henceforth referred to as the QD continuous nickel converter and methods.

The QD converter is a closed, fugitive emission-free, elongated, cylindrical, gently sloped, e.g. about 1%, tilting vessel for continuously treating primary furnace mattes of controlled sulfur content and discharging nickel and nickel-copper mattes containing less than about 1% iron at one end, while discharging low value-metal-containing slag and high sulfur dioxide-containing gas at the other end. Three distinct but interconnected zones comprise the reactor: 1) An oxidizing (matte) zone; 2) a reducing (slag cleaning) zone; and 3) an oxidizing gas top blown-gas bottom stirred (product finishing) zone.

Matte of controlled sulfur content is fed continuously to the bath in the oxidizing zone where oxygen is introduced into the bath through independently regulated, fluid shielded, submerged oxygen injectors so spaced and operated as to provide a series of mixer-settler bath regions of staged decreasing oxygen potential along the length of the zone in the direction of slag discharge. Reducing gases are introduced into the reducing zone bath by independently regulated, fluid shielded, submerged carbonaceous fuel-oxygen injectors which likewise provide a series of mixer-settler bath regions of staged, progressively decreasing oxygen potential to slag discharge. The metal values in the slag are recovered in a low-grade matte that flows to the oxidizing zone. The nickel-rich converted product flows to the oxidizing gas top blown-gas bottom stirred finishing zone for production of low iron matte and cobaltiferous mush. The finished product is continuously discharged at one end of the reactor, and value-metal-impoverished slag and sulfur dioxide-rich off-gas are continuously discharged at the opposite end of the reactor.

BRIEF DESCRIPTION OF THE DRAWING

The FIGURE is a cross-sectional elevation of an embodiment of the invention.

PREFERRED MODE FOR USE OF THE INVENTION

The FIGURE illustrates a QD continuous nickel matte converter 10. Conversion of matte occurs in oxidizing zone A, and slag cleaning occurs in reducing zone B. Further oxidation of the matte to high grade converted matte product and cobaltiferous mush occurs in the finishing zone C by oxygen top blowing and nitrogen bottom stirring.

The term "about" before a series of values, unless otherwise indicated, shall be interpreted as applying to each value in the series. The terms "left", "right", "distal" and "proximal" are non-limiting arbitrary conventions. They are used for ease of discussion purposes only.

The oxygen reactor 10 consists of a closed, fugitive emission-free, elongated, tilting, gently sloped, refractory lined cylinder 12, optionally stepped in diameter. It is sloped, e.g. about 1%, in order to gravity-drive the flow of matte 38 towards the low iron-matte product discharge taphole 30 of the reactor 10. Off-gases are routed out of the vessel 10 via off-take 20 for subsequent dust recovery and sulfur fixation. An array of cooling boiler tubes 22, for enhancing reactor thermal efficiency and for refractory temperature protection, may be mounted in the reactor atmosphere at selected sites below the roof of the refractory lined cylinder 12. The zone C is disposed at the proximal (left) end of the reactor 10 and the zone B is disposed at the distal (right) end of the reactor 10. The zone A is disposed intermediately between the proximal end and the distal end.

A refractory barrier 24, preferably cooled, extends from the roof of the reactor 10 towards the well or bottom section 26 of zone C and has a bath underflow passage 68 and a gas passage 18. An inclined reactor bottom wall 100 connects the well 26 of zone C and the section 14. The barrier 24 serves to physically bar slag 28 from entering finishing zone C, the top-blowing, bottom-stirring compartment 56. A molten bath 86 including the matte 38 and the slag 28 is maintained within the zones A and B of the reactor 10. The finished product, i.e., low iron matte and cobaltiferous mush, is discharged from zone C through product taphole 30. Clean slag 28 is discharged from zone B by slag discharge taphole 32. High sulfur dioxide-content gas leaves the reactor for further processing from off-take 20. The small fraction of off-gas generated in zone C exits through the gas passage 18 and is ultimately removed through the off-take 20.

The converter 10 is directed to the processing of iron-rich, nickel-cobalt and nickel-cobalt-copper mattes of controlled sulfur content by continuous oxygen converting in a largely autogenous manner. A matte of controlled sulfur content is defined as a matte with a composition that can be satisfactorily autogenously oxygen smelted-converted in oxidizing zone A. It is a matte that upon reacting with the oxygen injected through the oxidizing injectors 36 generates an amount of heat sufficient to satisfy all the heat requirements of oxidizing zone A, including compensating for radiation heat losses.

Controlling the heat balance for autogeneity of the process in oxidizing zone A of the converter 10, is done by one or more procedures:

Selecting matte feeds, preferably granulated, of appropriate chemical composition;

Adding nickel-rich recycled materials;

Adding water fog, preferably more than 25% by weight, e.g. 50%, to the gases injected through the submerged injectors;

Mounting steam-raising boiler tubes in the atmosphere of the reactor;

Partial pre-roasting of the matte feed, if such roasting is required to satisfy the autogeneity of the process.

Converting zone A is equipped with a plurality of fluid shielded, bubble plume-generating submerged oxygen injectors 36, each independently regulated. The injectors 36 are operated so as to provide a series of judiciously spaced apart, mixer-settler bath regions of staged oxygen potential. Space length is determined by the workload assigned to the individual injectors. Bubble plumes 82, of controlled chemical analysis and momentum, rise up through the bath 86, and are separated from each other by discrete quiescent regions 66.

The feed from source 90 consisting of: 1) a blend of granulated nickel-cobalt or nickel-cobalt-copper primary smelting matte, siliceous flux and optional recycled materials, of controlled sulfur content, or 2) iron-rich, nickel-cobalt matte or nickel-cobalt-copper matte, which optionally have been partially roasted, siliceous flux and optional recycled nickel-rich materials, is fed onto the bath 86 by lance injectors 84, preferably into or immediately in the vicinity of the emerging bubble plumes 82. Lancing of feed may be conducted with any appropriate gas, e.g., nitrogen, air or oxygen. With air or oxygen, partial oxidation of the feed occurs in the atmosphere of zone A.

As opposed to flash smelting practice where the metal sulfide feed must be dry and of fine particle size, the QD converter feed preferably consists of either wet or dry large particle size material, as commonly produced by water granulation of molten matte. Any entrained moisture in the feed utilizes excess heat in zone A. By using granulated feed, in conjunction with lower gas space velocities achieved by higher oxygen concentration of injector gas, less undesirable dust in off-gas results. It is normally preferred to maintain the temperature of the atmosphere in zone A in the range of about 1200–1300° C. When limited flash smelting of the matte feed occurs in zone A, a portion of the iron and sulfur is oxidized in the atmosphere. Converting continues in the molten bath 86 below. Oxygen and a shielding fluid are directly injected into the reactor 10 through the matte 38 via the submerged injectors 36.

Shielding gas, preferably the stable hydrocarbon methane or the low cost inert gas nitrogen, preferably carrying water fog, serves to protect the submerged injectors 36 and 40. A water fog may also be advantageously introduced with the oxygen. The amount of water fog so introduced is preferably large, e.g. 50% by weight of the combined shielding and oxygen gases. Methane minimizes momentum effects while maximizing cooling at the point of entry. The cracking of this hydrocarbon gas is strongly endothermic, thereby causing protective cooling in the vicinity of the injectors 36 and 40. Remotely cooled copper inserts (not shown) are advantageously employed to extend the life of the refractories around the injectors 36 and 40.

Matte 38 and slag 28 flow countercurrently as shown by the flow arrows in the bath 86. The vessel 12 is gently sloped to gravity-drive the flow of the matte 38 toward the proximal end of the reactor 10. Oxygen potential staging in zone A is achieved by independently controlling the required input chemistry (i.e. the matte feed/oxygen ratio) at each injector location. As a result, the iron content of the matte 38 decreases towards the proximal end of the reactor 10, and the magnetite ($Fe^{+++}/Fe^{++}$ ratio) content of the slag 28 and its value-metal content decrease toward the distal end of the converter 10. Solid recycled materials, such as nickel-rich scrap, residues and similar materials, can be usefully added to zone A for recovery of their value-metal content, and incidental temperature control of the molten bath 86.

In order to protect barrier refractory integrity, the first (left-most) injector 36 is spaced away from the barrier 24, to form a quiescent settling region 8 between the barrier 24 and the first (left-most) bubble plume.

A narrow baffle 78 bridging the bath 86, preferably cooled by remotely cooled copper inserts or internally conveyed water fog, may be employed to separate a minor upper portion of the slag layer 28 near the distal end of zone A from the major portion of the slag 28 below it, thereby enhancing a downstream quiescent region 92. Near the distal end of zone B, a similar baffle 78B performs likewise, while retaining floating solids such as coke breeze which may be added to the bath via lance 54. Coke addition provides useful reducing conditions on the surface of the slag 28, and prevents its reoxidation incidental to post-combustion of carbon monoxide and hydrogen in the converter 10 atmosphere.

Since oxygen potential control is essential in the formation of matte 38 and slag 28, monitoring of oxygen potentials along the interior of the reactor 10 is helpful. Potentials, i.e., oxygen partial pressures, on the order of $10^{-6.5}$ atmospheres at the proximal end of the zone C, of $10^{-7.5}$ atmospheres at the proximal end of zone A and of $10^{-12}$ atmospheres at the distal end of zone B are normally preferred.

As converting occurs in zone A, the nickel-rich, intermediate matte product 38A flows toward the left (proximal end) of the vessel 10 (as drawn) through the fluid passage 68 in the barrier 24 and collects in the well 26 of zone C. The intermediate product 38A of zone A is an about 3–5% iron, nickel or nickel-copper matte containing cobalt. It flows continuously to the preferably oxygen top blown-nitrogen bottom stirred finishing compartment 56, for oxidizing to matte 60 containing less than about 1% iron. This process generates a cobalt-containing mush 64 that floats to the top of the finishing zone bath 60. The reactor product, matte 60 and mush 64, flow through the taphole 30 to a separating vessel 80, such as a forehearth or a top blown rotary converter ("TBRC") for separation. The mush 64 is treated separately for nickel and cobalt isolation, thus maximizing recovery of by-product cobalt. The less than about 1% iron matte may be oxygen top-blown in the TBRC 80 to produce crude nickel metal. Refer to P. E. Queneau et al., U.S. Pat. No. 3,069,254. This product may then be refined to high purity metal by pressure carbonylation. Refer to P. E. Queneau, et al., U.S. Pat. No. 2,944,883.

The slag 28 is cleaned in the reducing zone B. This zone is equipped with a plurality of independently regulated, judiciously spaced, fluid-shielded, carbonaceous fuel-oxygen injectors 40 to provide a series of mixer-settler stages of controlled decreasing oxygen potential toward slag discharge. The weight ratio of the carbonaceous fuel-oxygen blend injected through the preferred Savard-Lee type injectors 40 is controlled to: a) provide regions of the required decreasing oxygen potentials in the bath, and b) supply the heat required by the endothermic reduction reactions, the melting of cold solid additives and part of the reactor radiation heat losses. The kinetics of the reduction reactions that take place in zone B is enhanced by high temperature. Accordingly, it is useful to operate reduction zone B at a temperature of about 1250°–1300° C.

Finely pulverized, reactive medium volatile bituminous coal is preferred, although gaseous and liquid carbonaceous fuels (i.e. natural gas and petroleum oil) may be employed. The coal is preferably conveyed to the injectors 40 by pneumatic, accurately metered, steady state, dense phase, uniform plug flow transport that uses an unusually small volume of air, i.e. about 100 kg of coal per $Nm^3$ of air. In contrast, usual industrial fine particle conveying practice employs dilute phase transport in a high velocity, turbulent, pulsing, varying instant analysis air stream with a high gas volume to solids ratio. For converting purposes, the resulting variable dilution of injector output by air's high nitrogen content decreases the efficiency of bubble plume heat and mass transfer, and undesirably increases gas momentum.

Each domain of chemical activity of a bubble plume is isolated by a discrete, effectively passive region surrounding it. Localized freezing of liquid on the injector tips provides a solid, porous protective capping 48 over the injector. The mass flow rate of the gases injected into the bath should not exceed that needed for break-up of the jet into a well developed bubble plume 42, characterized by maximal interfacial contact area. The rate of heat and mass transfer is directly proportional to the interfacial area's magnitude, and the reaction rate is inversely proportional to interfacial boundary layer thickness. Also the depth of slag 28 in zone B must be sufficient to give the bubble plume 42 ample residence time to accomplish its mission. This calls for minimal usurpation of local working volume by the finished product. Jetting of gases right through the reactor bath due to excessive momentum is detrimental to gas utilization efficiency. Heat and mass transfer from the reactor's post-combustion atmosphere back to the bath is poor. Such jetting is wasteful of costly inputs, and can result in unwanted splashing and sloshing, interference with bath chemistry and post-combustion problems.

The preferred fuel for slag reduction is medium volatile combustible matter (about 22–30% VM), finely pulverized (minus about 100 microns) bituminous coal. Upon its injection into a large volume of high temperature, high specific heat, well stirred slag 28, pyrolysis is virtually explosive. Cracking and combustion of expelled volatiles occur in milliseconds, followed by slower char combustion. The endothermic nature of some of the reactions that occur upon injection of the coal assist the shielding fluid in cooling the injectors 40. Although bituminous coal is the preferred fuel, natural gas may be used as a substitute, e.g., to supply most of reactor carbonaceous fuel input. Finely pulverized, highly reactive bituminous coal, or a strongly reactive gaseous or liquid hydrocarbon, may be co-injected and well mixed with the natural gas and oxygen to initiate early cracking, speedy decomposition and ignition of its methane content. An addition of such reactive carbonaceous material equivalent to a minor function in thermal value of the methane in natural gas, e.g., 15%, is sufficient. It triggers a chain combustion reaction speeding production of the carbon monoxide and hydrogen required for heat, and for reduction of $Fe^{+++}$ to $Fe^{++}$ in the slag 28 which is a highly endothermic and kinetically slow reaction.

Fine iron sulfide mineral flotation concentrate, e.g., pyrrhotite, may be sprayed via injector 54 over the surface of the slag 28 in reducing zone B of the reactor 10, to provide the iron sulfide required to form a low grade nickel-cobalt or nickel-cobalt-copper matte 38 from the dissolved portion of these metals. As the slag 28 flows toward the distal end of the reactor 10, this drenching iron sulfide rain initiates chemically reducing and physically washing effects throughout the slag, thus increasing the recovery of the contained value-metals into the matte 38. The fine iron sulfide particles may be advantageously introduced by sprinkler burners described by P. E. Queneau et al., U.S. Pat. No. 4,326,702. Metallic iron-rich materials such as iron and steel scrap, and ferrosilicon may be added via the lance injector 54 to form a metallized matte 38, with a high iron activity, in order to enhance the recovery of the nickel and, in particular, of the cobalt from the slag 28. Auxiliary inputs of oxygen and the above-referenced optional iron sulfide may be metered into zone B via lance injectors 52 and 54 respectively, or by the above-referenced sprinkler burners. Fuel burners 102 may provide additional heat input near slag discharge and in the finishing zone.

In the upper section of the finishing compartment 56, an oxidizing gas, preferably oxygen, is top blown onto the surface of the matte 60 via lance 58, while a bottom stirring gas, preferably nitrogen, is bottom injected into the matte 60 via a refractory porous plug 62. Although a refractory porous plug is preferred, alternative bottom-stirring gas injectors may be used, e.g., for oxidizing gas introduction. The top blowing oxidizing gas may be introduced by an oxy-fuel burner, the flame of which has an oxygen content substantially in excess of stoichiometric. The finished product, i.e., the low iron converted matte 60 and the cobaltiferous mush 64, flows via taphole 30 to the vessel 80—such as a forehearth or TBRC—for separation. The cobaltiferous mush is processed separately to maximize cobalt recovery. The off-gas from the oxidation reactions is routed out of the finishing zone 56 through the gas passage 18 and the off-take 20 for subsequent treatment.

In order to utilize the QD converter 10, the following operating parameters are suggested:

A) Feed.

Feeding of the high iron matte in granulated form—wet or dry—is preferred. The temperature of zone A is generally controlled at about 1200°–1300° C. Feeding of appropriate internal and external solid reverts, and energy saving, refractory protecting, boiler tubes 22, may be employed to maintain the atmosphere and bath temperatures in the oxidizing zone at preferred levels.

B) Feeding and Converting.

A mixture of appropriately sized solid materials, including siliceous flux, may be dropped or lanced into the vessel 10 via top lances 84. The lancing can be assisted with any appropriate gas, e.g., nitrogen, air or oxygen. A series of independently regulated, submerged injectors 36 inject oxygen and shielding fluid through the matte and slag layers 38 and 28 comprising the molten bath 86. The oxygen oxidizes the iron and the sulfur in zone A, forming FeO which reports to the slag 28, and $SO_2$ which exhausts through the off-take 20, progressively generating the heat required in zone A. The essential reactions are:

(a) $2FeS+3O_2 \rightarrow 2FeO+2SO_2$ and (b) $2FeO+SiO_2 \rightarrow 2FeO \cdot SiO_2$ Oxygen potentials on the order of $10^{-7.5}$ atmospheres are reached in the oxidizing zone A prior to matte flow to finishing zone C. As a result, nickel-cobalt or nickel-cobalt-copper mattes 38A containing about 3–5% iron flow into zone C. The countercurrent flow of slag 28 and matte 38 in the reactor 10, shown by the arrows, is thermodynamically designed to insure production of finished product in zone C, which is generally maintained at a product discharge potential on the order of $10^{-6.5}$ atmospheres. A non-linear flow of liquids travel to opposite ends of the reactor 10. Discrete equilibrium cells are formed in zones A and B, with bubble plumes-mixing regions 82 and 42 separated by quiescent regions 66 and 46. The desired oxygen potential staging is achieved by controlling the volume and analysis of gas injected in each chemical reaction location. Viewing the FIGURE, the oxygen potential, the slag $Fe^{3+}/Fe^{2+}$ ratio, and the grade of the matte 38 in the vessel 10 decrease to the right. As a result, the slag 28 passing from zone A to zone B has a controlled magnetite content, e.g., about 15%.

C) Slag Reduction and Cleaning.

In zone B, the slag 28 is reduced before discharge to a low magnetite content, i.e., about 3%, at temperatures of about 1250°–1300° C. Oxygen potentials on the order of about $10^{-12}$ atmospheres are reached at the slag discharge end of the reducing zone B. In the processing of nickel-cobalt or nickel-cobalt-copper mattes, the following reactions occur:

(c) $Fe_3O_4+(1+x)/2\ C \rightarrow 3\ FeO+x\ CO+(1-x)/2\ CO_2$, (d) $9\ NiO+7FeS \rightarrow 3\ Ni_3S_2+7\ FeO+SO_2$, (e) $Cu_2O+FeS \rightarrow Cu_2S+FeO$ and (f) $CoO+FeS \rightarrow CoS+FeO$ The value of x in reaction (c) depends on the oxygen potential required to cause the desired reduction at each injection location.

The metal sulfide droplets formed in the slag 28 by the above reactions coalesce, settle and collect as a low grade matte product 38 that flows countercurrently to the slag 28. Pyrrhotite particulates may be spread, solid or melted, over the slag 28 in reducing zone B by injector 54, to provide the FeS required to form the desired low grade reducing matte 38. Deoxidizing, metallic iron-rich and silicon-rich materials, such as iron or steel scrap and ferrosilicon, may be added via injector 54 to form a metallized matte 38 with a high iron activity, in order to enhance the recovery of the nickel and, in particular, of the cobalt from the slag 28. A discharge slag is thus produced containing less than 1% of the nickel, less than 25% of the cobalt and less than 1% of the copper in the converter feed. The value-metal content, e.g., the combined nickel, cobalt and copper content, of the discharge slag is less than 1 wt %.

Submerged partial combustion of the carbonaceous materials injected through injectors 40 takes place in zone B. Oxygen, finely pulverized bituminous coal and injector cooling shielding gas and water fog are injected through the injectors 40. The rate of injection of these materials by each of the injectors is independently controlled to achieve the following objectives: a) provide the low oxygen potentials required to cause the desired reduction of the slag; b) generate the heat required by the endothermic reduction reactions, and the melting of cold, solid additives, and to offset reactor radiation heat losses; c) form a protective porous solid 48 covering the injectors; and d) form controlled bubble plumes 42 containing a maximum number of small bubbles to maximize interfacial contact area of reactants during the mixing operation.

In the proximal section of region A, intermediate product 38A, i.e., about 3–5% iron nickel-cobalt or nickel-cobalt-copper matte, flows via liquid passage 68 to the finishing zone C.

D) Matte Finishing:

In finishing zone C, nitrogen is injected into the bath 60 through a refractory porous plug 62. Oxygen, is vertically injected via the lance 58, preferably along the axis of symmetry 72, into the bath eye 76 formed by the bottom-stirring nitrogen. Alternatively, the top blowing gas may be directed onto the sphere of stirring influence 74 immediately circumscribing the bath eye 76. The oxidation reactions take place at about 1200° C. Oxygen efficiencies of about 85% and higher are achieved. The heat generated by the exothermic oxidation reactions, and by a burner (not shown), provide for optional flux melting and for radiation heat losses from the external walls of finishing zone C. The gases formed are preferably continuously recycled to zone A via the gas passage 18.

The operating variables of the QD reactor 10, in both sulfide and oxide ore pyrometallurgy, are controlled to optimize cobalt recovery into the matte 38. This is accomplished in part by judiciously modulating the quantity of iron and silicon added to the slag 28 in the reducing zone B, and by producing matte iron levels of about 3–5% in oxidizing zone A and then about 1% or less in finishing zone C. A thin layer of cobaltiferous mush 64 is formed, resulting from the oxidation of the matte iron content down to about 1% or less, and the accompanying oxidation of minor amounts of nickel and a significant amount of the cobalt. The mush floats on the bath 60 except in the vicinity of the sphere of influence 74 around the bath eye 76. The high grade matte and mush are continuously and jointly discharged through outlet 30 into the separating vessel 80, such as a forehearth or a TBRC.

E) Nickel Matte/Cobaltiferous Mush Separation.

The separation of the supernatant mush 64 from the high grade nickel-cobalt or nickel-cobalt-copper matte 60 is achieved in the separator 80 by either rabbling solid mush from the surface of the bath, or by rendering the mush liquid by adding appropriate fluxes. In either case, it is advantageous to tap the high grade matte from the separator 80 through a passage located below the matte mush/slag interface to avoid contamination of the final product. Optional additional oxidation of the converted product can take place in the vessel 80 to adjust the final iron content of this material. Also, cooling of the matte in this vessel to temperatures compatible with its liquidus enhances the exsolution of additional amounts of iron and cobalt oxides. Judicious control of these operating parameters results in the production of a final high grade matte with only about 0.5% or less iron. The cobaltiferous mush/slag is processed separately to maximize cobalt recovery.

It is advantageous to employ a TBRC 80 to separate the mush/slag from the matte. In this case, following removal of the mush/slag, the matte may be oxygen top-blown in the TBRC to produce crude nickel metal, which is preferably then refined to high purity metal by pressure carbonylation.

While in accordance with the provisions of the statute, there are illustrated and described herein specific embodiments of the invention, those skilled in the art will understand that changes maybe made in the form of the invention covered by the claims. Certain features of the invention may sometimes be used to advantage without a corresponding use of the other features. Thus, the QD nickel matte converter can replace Peirce-Smith copper converters to eliminate fugitive emissions in the workplace, and efficiently produce low impurity blister copper from primary furnace copper mattes, with improvements in process costs, value-metal recovery, sulfur fixation, and the overall environment.

The embodiments of the invention in which an exclusive property or privilege is claimed are defined as follows:

1. A continuous nickel matte converter for directly converting high-iron nickel-cobalt and nickel-cobalt-copper mattes into low-iron mattes, slag of low value-metal content and gas of high sulfur dioxide content, this single oxygen reactor comprising a substantially closed, elongated, gently sloped downward toward product discharge, cylindrical, tilting, concurrent gas-slag flow and countercurrent matte-slag flow refractory lined vessel having a roof, the reactor subdivided into an oxidizing gas top-blown, gas bottom-stirred finishing zone, a slag reducing zone, and an oxidizing zone disposed intermediately between the finishing zone and the slag reducing zone, the reactor adapted to contain a molten bath including matte and slag, a barrier extending from the roof into the molten bath thereby partially separating the finishing zone from the oxidizing zone, the barrier including a bath underflow passage between the oxidizing zone and the finishing zone and a gas passage between the finishing zone atmosphere and the oxidizing zone atmosphere, a slag discharge taphole disposed at the end of the slag reducing zone, a product discharge taphole disposed at the end of the finishing zone, a gas off-take disposed near the end of the slag reducing zone, at least one bottom-stirring gas injector disposed in the bottom of the finishing zone, at least one top-blowing oxidizing gas injector disposed in the roof of the finishing zone, at least one material feeder disposed in the roof of the oxidizing zone, at least one material feeder disposed in the roof of the reducing zone, a plurality of spaced fluid-shielded, submerged oxygen injectors generating bath-oxidizing bubble plumes disposed in the bath of the oxidizing zone, a plurality of spaced, fluid-shielded, submerged carbonaceous fuel-oxygen injectors generating bath-reducing bubble plumes disposed in the bath of the reducing zone, quiescent bath settling regions interposed between each of the submerged oxygen injector bubble plumes and between each of the submerged carbonaceous fuel-oxygen injector bubble plumes, a quiescent settling region interposed between the plurality of submerged oxygen injector bubble plumes and the plurality of submerged carbonaceous fuel-oxygen injector bubble plumes, a quiescent settling region interposed between the plurality of submerged carbonaceous fuel-oxygen injector bubble plumes and the slag discharge, a quiescent settling region interposed between the plurality of submerged oxygen injector bubble plumes and the barrier, and the inputs to each of the submerged injectors independently regulated to control the oxygen potential along the length of the reactor.

2. The oxygen reactor according to claim 1 wherein a top-blowing oxidizing gas injector in the finishing zone is connected to an oxygen source.

3. The oxygen reactor according to claim 1 wherein the finishing zone includes a porous refractory plug connected to a nitrogen source.

4. The oxygen reactor according to claim 1 wherein the top-blowing oxidizing gas injector is an oxy-fuel burner.

5. The oxygen reactor according to claim 1 wherein an injector disposed in the bottom of the finishing zone is connected to a source of a bottom stirring oxidizing gas.

6. The oxygen reactor according to claim 1 including a baffle bridging the bath and extending shallowly into both the slag below and into the atmosphere above, substantially between the oxidizing zone and the reducing zone.

7. The oxygen reactor according to claim 1 including a baffle bridging the bath and extending shallowly into both the slag below and into the atmosphere above, near the slag discharge.

8. The oxygen reactor according to claim 1 wherein the fluid shield of the submerged injectors in the oxidizing and reducing zones is connected to a gas source selected from the group consisting of nitrogen and methane.

9. The oxygen reactor according to claim 1 wherein the carbonaceous fuel-oxygen injectors are connected to a fuel source selected from the group consisting of coal and natural gas.

10. The oxygen reactor according to claim 1 wherein a feeder disposed in the roof of the reducing zone is connected to a source including materials selected from the group consisting of coal, coke, carbonaceous liquid fuel, carbonaceous gaseous fuel, iron sulfide-rich fine concentrate, iron and steel scrap, ferrosilicon, and oxygen.

11. The oxygen reactor according to claim 1 including an array of refractory-protecting, steam-raising boiler tubes disposed below the roof of the reactor.

12. The oxygen reactor according to claim 1 in which the refractory lining immediately surrounding the submerged injectors contains remotely cooled, refractory-protecting, copper inserts.

13. The oxygen reactor according to claim 1 wherein the vessel slopes downwardly about 1% toward product discharge.

14. The oxygen reactor according to claim 1 wherein the inputs to each of the submerged injectors are independently regulated to control bath oxygen potential along the length of the reactor, such that this potential decreases progressively from product discharge to slag discharge.

15. A system for directly and continuously converting high iron nickel-cobalt and nickel-cobalt-copper mattes into low-iron mattes, a low value-metal containing discard slag and a gas of high sulfur dioxide content, the system comprising an oxygen reactor, the reactor including a substantially closed, elongated, gently sloped downward toward product discharge, cylindrical, tilting, concurrent gas-slag flow and countercurrent matte-slag flow refractory lined vessel having a roof, the reactor subdivided into an oxidizing gas top-blown, gas bottom-stirred finishing zone, a slag reducing zone, and an oxidizing zone disposed intermediately between the finishing zone and the slag reducing zone, the reactor adapted to contain a molten bath including matte and slag, a barrier extending from the roof into the molten bath thereby partially separating the finishing zone from the oxidizing zone, the barrier including a bath underflow passage between the oxidizing zone and the finishing zone and a gas passage between the finishing zone atmosphere and the oxidizing zone atmosphere, a slag discharge taphole disposed at the end of the slag reducing zone, a product discharge taphole disposed at the end of the finishing zone, a gas off-take disposed near the end of the slag reducing zone, at least one bottom-stirring gas injector disposed in the bottom of the finishing zone, at least one top-blowing oxidizing gas injector disposed in the roof of the finishing zone, at least one material feeder disposed in the roof of the oxidizing zone, at least one material feeder disposed in the roof of the reducing zone, a plurality of spaced fluid-shielded, submerged oxygen injectors generating bath-oxidizing bubble plumes disposed in the bath of the oxidizing zone, a plurality of spaced fluid-shielded, submerged carbonaceous fuel-oxygen injectors generating bath-reducing bubble plumes disposed in the bath of the reducing zone, quiescent bath settling regions interposed between each of the submerged oxygen injector bubble plumes and between each of the submerged carbonaceous fuel-oxygen injector bubble plumes, a quiescent settling region interposed between the plurality of submerged oxygen injector bubble plumes and the plurality of submerged carbonaceous fuel-oxygen injector bubble plumes, a quiescent settling region interposed between the plurality of submerged carbonaceous fuel-oxygen injector bubble plumes and the slag discharge, a quiescent settling region interposed between the plurality of submerged oxygen injector bubble plumes and the barrier, and the inputs to each of the submerged injectors independently regulated to control the oxygen potential along the length of the reactor, and the product discharge taphole connected to a subsequent treatment facility.

16. The system according to claim 15 wherein the product discharge taphole is connected to a separating vessel.

17. The system according to claim 16 wherein the separating vessel is selected from the group consisting of a forehearth and a top blown rotary converter.

18. The system according to claim 15 connected to a source of feed selected from the group consisting of high-iron nickel-cobalt and nickel-cobalt-copper mattes and nickel-rich recycled materials, all of controlled sulfur content.

19. The system according to claim 15 including an array of refractory-protecting, steatn-raising boiler tubes disposed below the roof of the reactor.

20. The system according to claim 15 in which the refractory lining immediately surrounding the submerged injectors contains remotely cooled, refractory-protecting, copper inserts.

21. The system according to claim 15 wherein the vessel slopes downwardly about 1% toward product discharge.

22. The system according to claim 15 wherein the inputs to each of the submerged injectors are independently regulated to control oxygen potential along the length of the reactor, such that this potential decreases progressively from product discharge to slag discharge.

23. A continuous process for maximizing the recovery of value-metal from high-iron nickel-cobalt and nickel-cobalt-copper mattes of controlled sulfur content while converting a reactor feed into a low-iron matte product and maximizing the sulfur dioxide concentration of the resultant off-gas, the process comprising establishing a molten bath in a substantially closed, elongated, gently sloped downward toward product discharge, cylindrical, tilting, concurrent gas-slag flow and serially locally agitated, countercurrent matte-slag flow, refractory lined vessel, subdivided into an oxidizing gas top blown, gas-bottom stirred finishing zone having a bath eye therein, a reducing zone, and an intermediate oxidizing zone disposed therebetween, the finishing zone and the oxidizing zone separated by a barrier extending from the roof into the molten bath, the barrier including a bath underflow passage between the oxidizing zone and the finishing zone and a gas passage between the finishing zone atmosphere and the oxidizing zone atmosphere, introducing solid reactants selected from the group consisting of mattes, roasted mattes, fluxes, pyrite, pyrrhotite, iron and steel scrap, ferrosilicon and carbonaceous and appropriate recycled materials into the vessel, introducing reactants selected from the group consisting of oxygen, nitrogen, natural gas, petroleum oil, coal and water into the vessel by a plurality of regulated, spaced, fluid-shielded, submerged injectors disposed in the oxidizing and reducing zones, converting the solid reactants to form fluid matte and slag in the oxidizing zone, treating the slag in the reducing zone to recover its value-metal content, establishing in the oxidizing zone bath a sequential plurality of increasingly oxidizing bubble plume turbulent mixing regions each separated by a quiescent settling region as the matte flows at increasingly high oxygen potential to the finishing zone, establishing in the reducing zone bath a sequential plurality of increasingly reducing bubble plume turbulent mixing regions each separated by a quiescent settling region as the slag thus flows at increasingly low oxygen potential to a discharge taphole, flowing the matte produced in the oxidizing zone into the finishing zone for final increase in oxygen potential and decrease in its iron content and production of a floating cobalt-rich mush, and discharging the reactor products.

24. The process according to claim 23 wherein the finishing zone product is selected from the group consisting of low-iron nickel-cobalt matte, and low-iron nickel-cobalt-copper matte.

25. The process according to claim 23 wherein the oxygen employed analyzes over about 95% volumetrically.

26. The process according to claim 23 wherein the feed is selected from the group of materials containing primarily nickel, cobalt, copper, iron and sulfur.

27. The process according to claim 23 in which an approximately 3 to 5% iron-containing nickel-rich matte is produced by converting a high-iron nickel-rich matte feed, treating the slag produced to recover its value-metal content, and producing an off-gas rich in sulfur dioxide.

28. The process according to claim 23 employing oxygen top-blowing and nitrogen bottom-stirring of the matte produced in the oxidizing zone.

29. The process according to claim 23 employing oxygen top-blowing and nitrogen bottom-stirring the matte produced in the oxidizing zone down to less than about a 1% iron nickel-rich matte and a cobalt-rich mush in the finishing zone.

30. The process according to claim 29 including separate treatment of the cobalt-rich mush for cobalt production.

31. The process according to claim 23 employing oxidizing oxy-fuel burner gas top-blowing and oxidizing gas bottom-stirring the matte produced in the oxidizing zone, down to a nickel-rich matte containing less than about a 1% iron, and a cobalt-rich mush in the finishing zone.

32. The process according to claim 31 including separate treatment of the cobalt-rich mush for cobalt production.

33. The process according to claim 23 including oxidizing the less than about 1% iron nickel-rich matte to crude nickel metal in an oxygen top-blown rotary converter followed by its direct vapometallurgical refining to high purity nickel by pressure carbonylation.

34. The process according to claim 23 wherein the injectors are sequentially spaced apart from one another in the oxidizing zone to create a plurality of substantially discrete, controlled turbulence, physical mixing regions characterized by bubble plumes of controlled chemical analysis for efficient heat and mass transfer, and separated by quiescent regions for effective gravity settling.

35. The process according to claim 23 including slag cleaning by introducing carbonaceous substances, oxygen and shielding fluid through a plurality of independently regulated injectors submerged in the molten bath.

36. The process according to claim 35 wherein the injectors are sequentially spaced apart from one another in the reducing zone to create a plurality of substantially discrete, controlled turbulence, physical mixing regions characterized by bubble plumes of controlled chemical analysis for efficient heat and mass transfer, and separated by quiescent regions for effective gravity settling.

37. The process according to claim 23 including heat recovery and refractory protection by an array of boiler tubes disposed below the roof of the reactor.

38. The process according to claim 23 wherein the reactor bath oxygen potentials decrease progressively from the low iron matte discharge taphole to the low value-metal slag discharge taphole.

39. The process according to claim 38 wherein the oxygen potentials decrease from a maximum of about $10^{-6.5}$ atmospheres in the finishing zone to about $10^{-7.5}$ atmospheres in the oxidizing zone, to a minimum of about $10^{-12}$ atmospheres in the reducing zone.

40. The process according to claim 23 wherein the submerged injector fluid-shield is selected from the group consisting of nitrogen, methane, and water fog.

41. The process according to claim 40 in which the water fog is introduced into both the fluid shield and the oxygen, and is over 25% by weight of the two combined.

42. The process according to claim 23 wherein about minus 100 micron bituminous coal is fed to the reducing zone submerged injectors at controlled steady rates via dense phase uniform plug flow transport.

43. The process according to claim 23 including spreading coke over the slag in the reducing zone.

44. The process according to claim 23 wherein the matte flows by gravity into the finishing zone through the bath underflow passage in the barrier.

45. The process according to claim 23 including roasting a high-iron matte feed for sulfur content control prior to its introduction into the reactor.

46. The process according to claim 23 wherein the sulfur dioxide-rich off-gas is drawn off concurrently with the slag.

47. The process according to claim 23 wherein the mass flow rates of submerged injector gas inputs are controlled to form chemically and physically efficient bubble plumes, with substantially no jetting of gases out of the molten bath.

48. The process according to claim 23 wherein the reactor feed includes slag-forming flux.

49. The process according to claim 23 wherein the reactor high iron, nickel-rich matte feed is water-granulated.

50. The process according to claim 23 wherein the reactor feed is selected from the group consisting of nickel-cobalt mattes, nickel-cobalt-copper mattes, and nickel-, cobalt-, and copper-containing recycled materials, all of controlled sulfur content.

51. The process according to claim 23 wherein off-gases generated in the finishing zone pass into the oxidizing zone through a gas passage in the barrier.

52. The process according to claim 23 including establishing a quiescent settling region between the barrier and the first fluid-shielded, submerged injector in the oxidizing zone.

53. The process according to claim 23 including establishing a quiescent settling region in the reducing zone in the vicinity of the slag discharge taphole.

54. The process according to claim 23 including establishing a quiescent settling region in between each of the spaced, fluid-shielded, submerged injectors in the oxidizing and reducing zones.

55. The process according to claim 29 including producing a stag containing less than 1% of the nickel, less than 25% of the cobalt and less than 1% of the copper in the converter feed.

56. The process according to claim 31 including producing a slag containing less than 1% of the nickel, less than 25% of the cobalt and less than 1% of the copper in the converter feed.

57. The process according to claim 29 including producing an off-gas containing over about 60% by volume of sulfur dioxide, dry basis.

58. The process according to claim 31 including producing an off-gas containing over about 60% by value of sulfur dioxide, dry basis.

59. The process according to claim 23, including treating a primary furnace matte containing over 10% iron, producing a matte therefrom containing less than 1% iron, a slag containing less than 1% value-metal and an off-gas containing over 60% by volume of sulfur dioxide, dry basis.

60. The process according to claim 23 including introducing natural gas containing a thermally minor quantity of a fuel selected from the group consisting of minus 100 micron, highly reactive bituminous coal, a highly reactive liquid hydrocarbon, and a highly reactive gaseous hydrocarbon, to the bubble plume turbulent mixing regions, through submerged injectors disposed in the reducing zone.

* * * * *